US010365061B1

(12) United States Patent
Painter

(10) Patent No.: US 10,365,061 B1
(45) Date of Patent: Jul. 30, 2019

(54) FIREARM BARREL WITH NON-METAL OUTER SLEEVE

(71) Applicant: Aaron E. Painter, Elkhorn, WI (US)

(72) Inventor: Aaron E. Painter, Elkhorn, WI (US)

( * ) Notice: Subject to any disclaimer, the term of this patent is extended or adjusted under 35 U.S.C. 154(b) by 244 days.

(21) Appl. No.: 15/394,155

(22) Filed: Dec. 29, 2016

(51) Int. Cl.
*F41A 21/44* (2006.01)
*F41A 21/28* (2006.01)

(52) U.S. Cl.
CPC ..... *F41A 21/44* (2013.01); *F41A 21/28* (2013.01)

(58) Field of Classification Search
CPC ..... F41A 21/44; F41A 21/00; F41A 21/02; F41A 21/10; F41A 21/08; F41A 21/20; F41A 21/24; F41A 21/28
USPC ..... 89/14.05, 16, 14.1
See application file for complete search history.

(56) References Cited

U.S. PATENT DOCUMENTS 855,439 A * 6/1907 Adrianson ..... F41A 21/28 181/223
2,935,912 A * 5/1960 Hartley ..... F41A 13/12 42/76.02
2,965,994 A * 12/1960 Sullivan ..... F41C 23/16 42/71.01
3,118,243 A * 1/1964 Manshel ..... F41A 21/02 42/76.02
3,367,054 A * 2/1968 Loffler ..... B29D 23/001 42/71.01
3,486,411 A * 12/1969 Lichtenstern ..... F41A 21/00 89/16
3,742,640 A * 7/1973 Thomsen ..... F41A 21/02 42/76.01
3,805,434 A * 4/1974 Sudano ..... F41A 21/10 42/77
4,638,713 A * 1/1987 Milne ..... F41A 21/44 89/14.1
4,762,048 A * 8/1988 Higashi ..... F41A 13/12 165/47
4,769,938 A * 9/1988 Chesnut ..... F41A 21/02 42/124
4,841,836 A * 6/1989 Bundy ..... F41A 21/44 89/14.1
4,911,060 A * 3/1990 Greenspan ..... F41A 21/02 42/76.02
4,982,648 A * 1/1991 Bol ..... F41A 13/12 89/14.1
5,125,179 A * 6/1992 Campbell ..... B29C 70/56 42/76.02

(Continued)

*Primary Examiner* — Joshua E Freeman
*Assistant Examiner* — Bridget A Cochran
(74) *Attorney, Agent, or Firm* — Donald J. Ersler

(57) ABSTRACT

A firearm barrel with non-metal outer sleeve preferably includes an elongated tube, a first non-metal tube, a second non-metal tube, a sleeve nut and a coupler bushing. A first raised sleeve support section and a raised coupler section are formed on the elongated sleeve. The raised coupler section is formed in substantially a middle of the elongated tube. The bushing inner diameter is sized to slidably receive an outer diameter of the raised coupler section. The first and second non-metal tubes include a tube inner diameter and a plurality of openings formed through a wall thereof. The tube inner diameters are sized to slidably receive an outer diameter of the first raised sleeve support section and each end of the coupler bushing. The sleeve nut retains the first and second non-metal tubes and the coupler bushing on the elongated tube.

16 Claims, 4 Drawing Sheets

(56) References Cited

U.S. PATENT DOCUMENTS 5,160,802 A * 11/1992 Moscrip ..... F41A 21/02 89/14.7
5,214,234 A * 5/1993 Divecha ..... F41A 21/02 42/76.02
5,341,719 A * 8/1994 Bullis ..... B21C 23/22 89/14.05
5,581,928 A * 12/1996 Krumm ..... C09D 171/00 42/76.01
5,600,912 A * 2/1997 Smith ..... F41A 21/02 42/76.01
5,650,586 A * 7/1997 Balbo ..... F41A 21/44 89/14.05
5,692,334 A * 12/1997 Christensen ..... F41A 21/02 42/76.02
5,856,631 A * 1/1999 Julien ..... F41A 21/02 42/76.02
5,928,799 A * 7/1999 Sherman ..... B32B 15/00 428/655
6,189,431 B1 * 2/2001 Danner ..... F41A 21/02 42/76.02
6,355,338 B1 * 3/2002 Hilmas ..... C04B 35/622 428/297.1
6,497,065 B1 * 12/2002 Huston ..... F41A 21/02 42/76.02
6,838,162 B1 * 1/2005 Gruber ..... C04B 35/573 428/293.4
7,353,741 B2 * 4/2008 Brixius ..... F41A 13/06 42/90
7,721,478 B2 * 5/2010 Withers ..... F41A 21/20 42/76.02
7,775,200 B2 * 8/2010 Anderson ..... F41B 11/00 124/83
7,866,079 B2 * 1/2011 Keeney ..... F41A 21/02 42/76.01
7,921,590 B2 * 4/2011 Briggs ..... F41A 21/04 42/76.02
7,934,332 B2 * 5/2011 Briggs ..... F41A 21/02 29/520
8,161,753 B2 * 4/2012 Benoit ..... C04B 37/025 416/241 B
8,281,698 B2 * 10/2012 Haywood ..... F41A 21/482 42/75.01
8,312,663 B2 * 11/2012 Johnson ..... F41A 23/16 42/76.01
8,336,243 B2 * 12/2012 Langevin ..... F41C 23/16 42/71.01
8,677,670 B2 * 3/2014 Christensen ..... F41A 21/04 42/78
9,222,756 B1 * 12/2015 Battaglia ..... F41C 27/00
9,658,010 B1 * 5/2017 Oglesby ..... F41A 13/12
9,796,057 B2 * 10/2017 Tertin ..... B23P 11/025
9,823,034 B2 * 11/2017 Johnson ..... F41A 21/36
2004/0244257 A1 * 12/2004 Degerness ..... F41A 21/02 42/76.02
2005/0115398 A1 * 6/2005 Olson ..... F41A 21/00 89/193
2005/0132872 A1 * 6/2005 Jensen ..... F41A 21/00 89/14.5
2005/0229464 A1 * 10/2005 Olson ..... F41A 21/24 42/76.02
2006/0207152 A1 * 9/2006 Lazor ..... F41C 23/16 42/71.01
2006/0236582 A1 * 10/2006 Lewis ..... F41A 3/26 42/73
2007/0256345 A1 * 11/2007 Hall ..... F41A 21/02 42/76.1
2008/0143005 A1 * 6/2008 Lim ..... C04B 35/565 264/29.2
2010/0162608 A1 * 7/2010 McCann ..... F41C 23/14 42/71.01
2011/0100204 A1 * 5/2011 Schlenkert ..... F41A 13/12 89/14.1
2011/0119981 A1 * 5/2011 Larue ..... F41C 23/16 42/71.01
2011/0146130 A1 * 6/2011 Emde ..... F41A 21/44 42/96
2011/0277623 A1 * 11/2011 Adolphsen ..... F41A 5/06 89/193
2012/0180358 A1 * 7/2012 Samson ..... F41A 13/12 42/71.01
2012/0227302 A1 * 9/2012 Fonte ..... F41A 21/02 42/78
2013/0036902 A1 * 2/2013 Adolphsen ..... F41A 5/26 89/193
2013/0061503 A1 * 3/2013 W. ..... F41A 21/44 42/76.01
2013/0247439 A1 * 9/2013 Johnson ..... F41A 13/12 42/97
2013/0276342 A1 * 10/2013 Chvala ..... F41A 13/12 42/90
2014/0076135 A1 * 3/2014 Balthaser ..... F41A 21/44 89/14.1
2014/0082990 A1 * 3/2014 Lee ..... F41A 21/24 42/96
2014/0305019 A1 * 10/2014 King, Jr. ..... F41C 23/18 42/71.01
2015/0369558 A1 * 12/2015 Gottzmann ..... F41C 23/16 42/71.01
2016/0290761 A1 * 10/2016 Cook, Jr. ..... F41A 21/44
2017/0138692 A1 * 5/2017 Tubb ..... F41A 21/44
2017/0205172 A1 * 7/2017 Curliss ..... F41A 21/02
2017/0299299 A1 * 10/2017 W. ..... F41A 13/12
2018/0017350 A1 * 1/2018 Kowalski ..... F41A 21/02

* cited by examiner 10
14
16
20
22
24
26
28
30
32
33
38
54
56
58
60
62
66
100

FIREARM BARREL WITH NON-METAL OUTER SLEEVE

BACKGROUND OF THE INVENTION

1. Field of the Invention

The present invention relates generally to firearms and more specifically to a firearm barrel with non-metal outer sleeve, which may be handled after use.

2. Discussion of the Prior Art

It appears that the prior art does not teach or suggest a firearm barrel with non-metal outer sleeve, which may be handled after use.

Accordingly, there is a clearly felt need in the art for a firearm barrel with non-metal outer sleeve, which may be handled after repeated firings.

SUMMARY OF THE INVENTION

The present invention provides a firearm barrel with non-metal outer sleeve, which may be handled after use. The firearm barrel with non-metal outer sleeve preferably includes a firearm barrel, a first non-metal tube, a second non-metal tube, a sleeve nut and a coupler bushing. The firearm barrel includes an elongated tube. A barrel inner diameter is formed through a length of the elongated tube. A lead-in bore is formed concentric with the barrel inner diameter at an entrance end of the elongated tube. A threaded tap is preferably formed in the entrance end of the elongated tube to threadably receive an extension barrel. Suitable twist rifling is then applied to the barrel inner diameter. Material is preferably removed from the elongated tube to form an end flange, a reduced outer diameter, a first raised sleeve support section and a raised coupler section. The end flange is formed on an entrance end of the elongated tube. The first sleeve support is formed near the end flange. The raised coupler section is formed in substantially a middle of the elongated tube. A gas escape hole is formed through the raised coupler section to the barrel inner diameter. A sleeve thread is formed on an exit end of the elongated tube. The firearm barrel is preferably fabricated from any suitable steel, but other materials may also be used.

The coupler bushing includes a bushing inner diameter, a first reduced diameter and a second reduced diameter. The first reduced diameter is formed on a first end of the coupler bushing and the second reduced diameter end formed on a second end thereof. A combination gas escape and fastener hole is formed through the coupler bushing. The bushing inner diameter is sized to slidably receive an outer diameter of the raised coupler section. The coupler bushing is preferably fabricated from any suitable metal, such as steel. The first non-metal tube includes a first tube inner diameter and a plurality of first openings are formed through a wall of the first non-metal tube. The plurality of first openings may have any suitable spacing, size and shape. The first tube inner diameter is sized to slidably receive an outer diameter of the first raised sleeve support section and the first reduced diameter. The first non-metal tube is preferably fabricated from carbon fiber, but other non-metal materials could also be used.

The sleeve nut preferably includes a tube end and a rotation flange. The rotation flange is formed on an end of the tube end. A threaded bore is formed through a length of the sleeve nut to threadably receive the sleeve thread of the elongated tube. A plurality of holes are preferably formed in the rotation flange to receive pins of a spanner wrench. However, wrench flats could be formed on an outer perimeter of the rotation flange. The second non-metal tube includes a second tube inner diameter and a plurality of second openings are formed through a wall of the second non-metal tube. The plurality of second openings may have any suitable spacing, size and shape. The second tube inner diameter is sized to slidably receive an outer diameter of the second reduced diameter and the tube end of the sleeve nut. The second non-metal tube is preferably fabricated from carbon fiber, but other non-metal materials could also be used.

The firearm barrel with non-metal outer sleeve is preferably assembled in the following manner. The first non-metal tube is slid over the exit end of the elongated tube on to the first raised sleeve support section. The coupler bushing is slid over the exit end of the elongated tube and on to the raised coupler section. The first reduced diameter of the coupler bushing is slid into the first tube inner diameter of the first non-metal tube. The combination gas escape and fastener hole of the bushing sleeve is aligned with the gas escape hole of the elongated barrel. A gas block is slid over the bushing sleeve. A threaded fastener is inserted through a hole in the gas block and the combination gas escape and fastener hole and threaded into a threaded tap in one end of the combination gas escape and fastener hole. The second non-metal tube is slid over the exit end of the elongated tube and on to the second reduced diameter of the coupler bushing. The sleeve nut is threaded onto the sleeve thread to retain the first and second non-metal tubes on the elongated tube.

Accordingly, it is an object of the present invention to provide a firearm barrel with non-metal outer sleeve, which may be handled after repeated firings.

These and additional objects, advantages, features and benefits of the present invention will become apparent from the following specification.

DETAILED DESCRIPTION OF THE PREFERRED EMBODIMENTS

Figure 1:
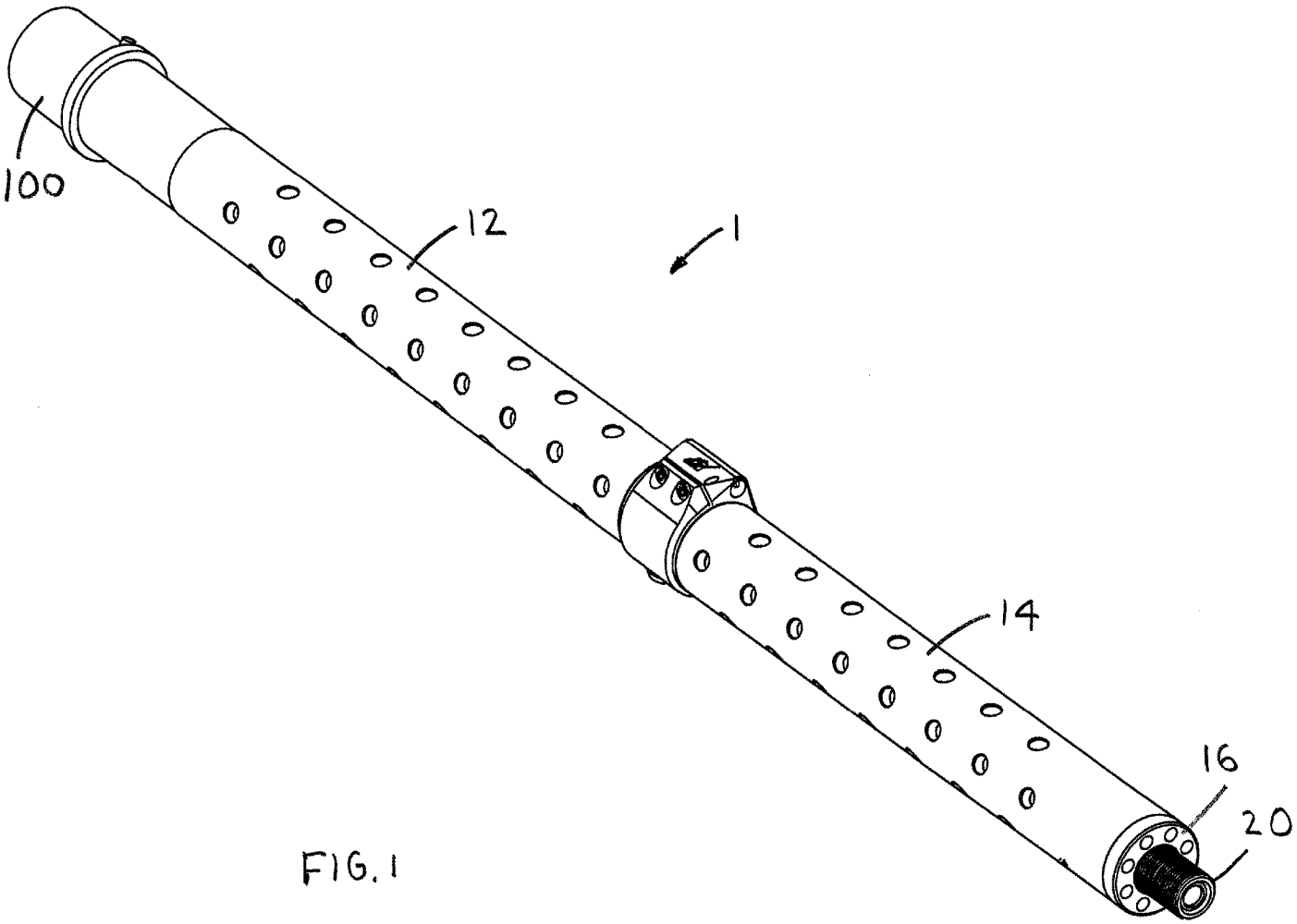
FIG. 1 is a perspective view of a firearm barrel with non-metal outer sleeve in accordance with the present invention.
Figures 2, 3, 4:
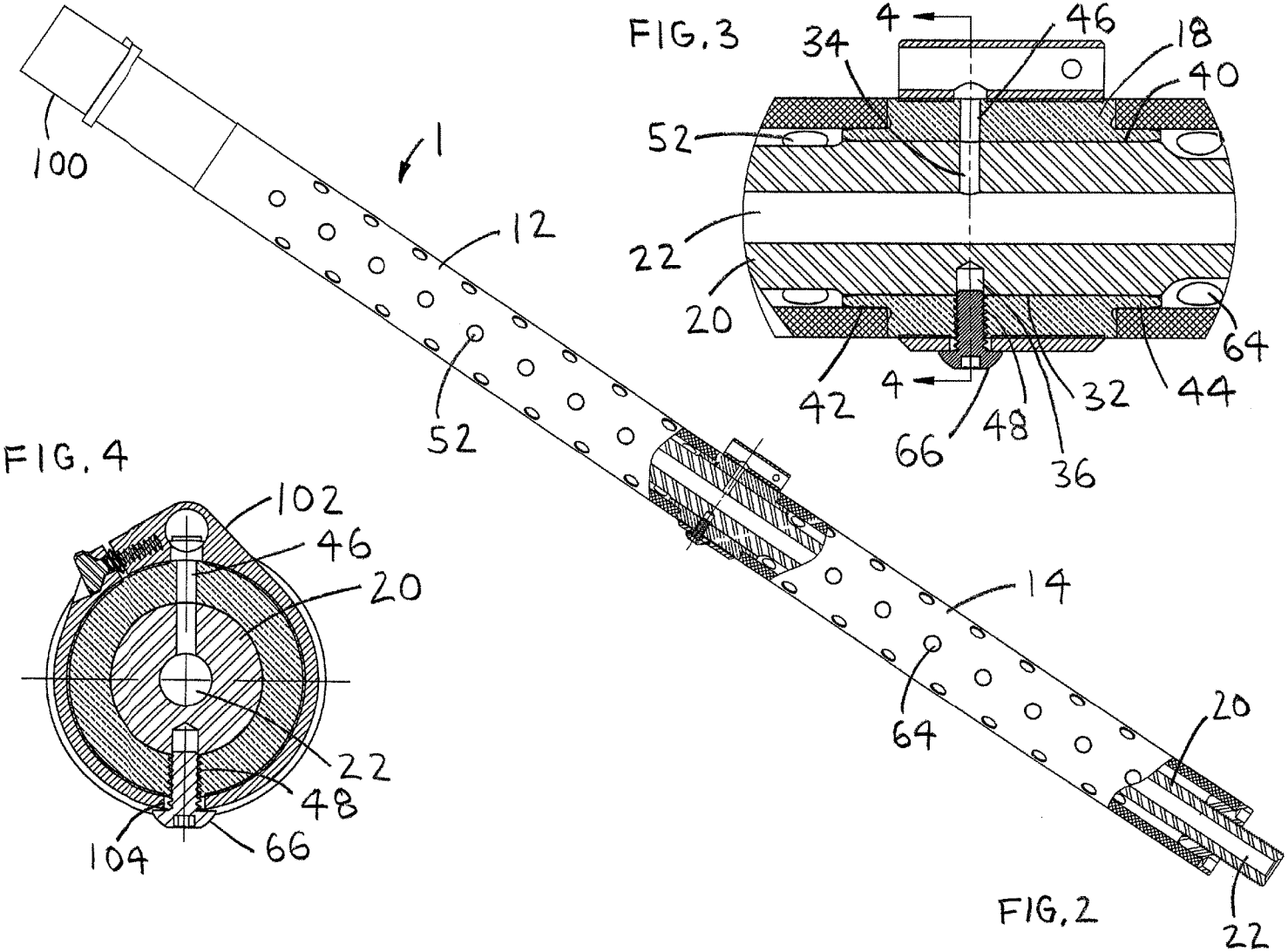
FIG. 2 is a side view of a firearm barrel with non-metal outer sleeve with cut-away sections of a gas block, coupler bushing and sleeve nut in accordance with the present invention.
FIG. 3 is an enlarged cut-away view of a gas block and coupler bushing of a firearm barrel with non-metal outer sleeve in accordance with the present invention.
FIG. 4 is an enlarged cross sectional view of a gas block and coupler bushing of a firearm barrel with non-metal outer sleeve cut through FIG. 3 in accordance with the present invention.
Figures 5, 6, 7:
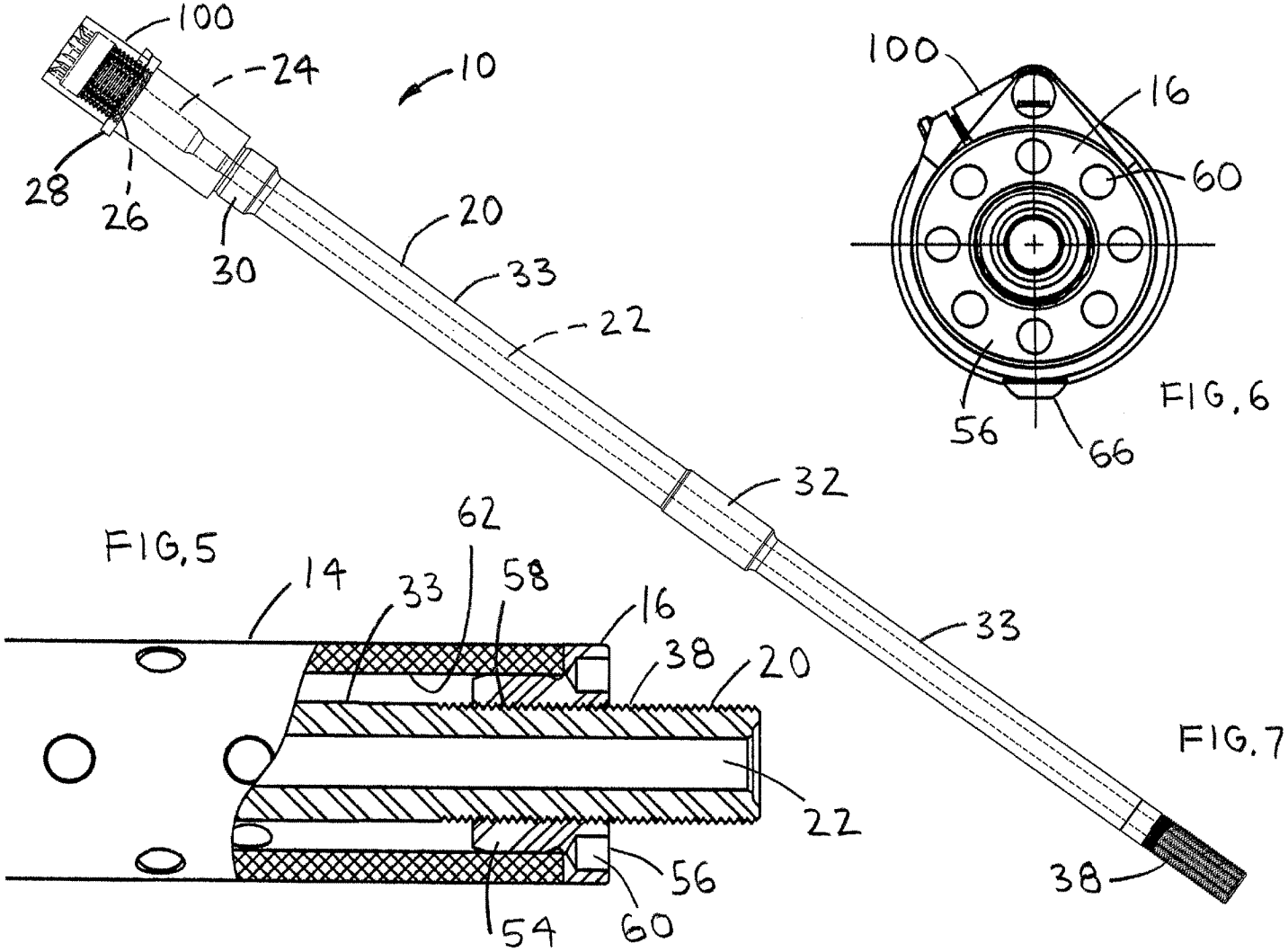
FIG. 5 is an enlarged cut-away view of a sleeve nut of a firearm barrel with non-metal outer sleeve in accordance with the present invention.
FIG. 6 is an enlarged end view of a firearm barrel with non-metal outer sleeve in accordance with the present invention.
FIG. 7 is a side view of an elongated tube of a firearm barrel with non-metal outer sleeve in accordance with the present invention.

With reference now to the drawings, and particularly to FIG. 1, there is shown a perspective view of a firearm barrel with non-metal outer sleeve 1. With reference to FIGS. 2-7, the firearm barrel with non-metal outer sleeve 1 preferably includes a firearm barrel 10, a first non-metal tube 12, a second non-metal tube 14, a sleeve nut 16 and a coupler bushing 18. The firearm barrel 10 includes an elongated tube 20. A barrel inner diameter 22 is formed through a length of the elongated tube 20. A lead-in bore 24 is formed concentric with the barrel inner diameter 22 at an entrance end of the elongated tube 20. A threaded tap 26 is preferably formed in the entrance end of the elongated tube 20 to receive an extension barrel 100. Extension barrels are well known in the art and do not need to explained in detail. Suitable twist rifling is then applied to the barrel inner diameter 22. Material is preferably removed from the elongated tube 20 to form an end flange 28, a first raised sleeve support section 30, a raised coupler section 32 and a reduced outer diameter 33. The reduced diameter 33 has a diameter measurement, which is less than a diameter measurement of the first raised sleeve support section 30 and the raised coupler section 32. The end flange 28 is formed on the entrance end of the elongated tube 20. The first sleeve support 32 is formed near the end flange 28. The raised coupler section 32 is formed in substantially a middle of the elongated tube 20. A gas escape hole 34 is formed through the raised coupler section 32 to the barrel inner diameter 22. A barrel clearance hole 36 is formed in the raised coupler section 32, but not through to the barrel inner diameter 22. A sleeve thread 38 is formed on an exit end of the elongated tube 20. The firearm barrel 10 is preferably fabricated from any suitable steel, but other materials may also be used.

Figure 8:
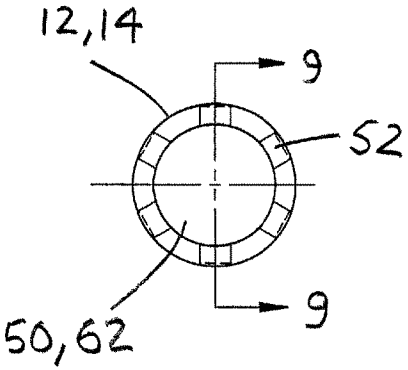
FIG. 8 is an end view of a first or second non-metal tube of a firearm barrel with non-metal outer sleeve in accordance with the present invention.
Figure 9:
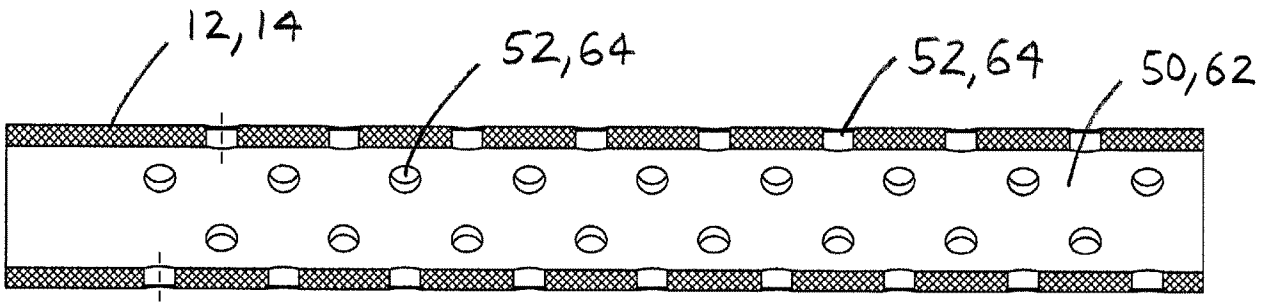
FIG. 9 is a cross-sectional view of a first or second non-metal tube of a firearm barrel with non-metal outer sleeve cut through FIG. 8 in accordance with the present invention.

The coupler bushing 18 includes a bushing inner diameter 40, a first reduced diameter 42 and a second reduced diameter 44. The first reduced diameter 42 is formed on a first end of the coupler bushing 18 and the second reduced diameter end 44 formed on a second end thereof. A combination gas escape and fastener hole 46 is formed through coupler bushing 18. A threaded tap 48 is formed in one end of the combination gas escape and fastener hole 46. The bushing inner diameter 40 is sized to slidably receive an outer diameter of the raised coupler section 32. The coupler bushing 18 is preferably fabricated from any suitable metal, such as steel. With reference to FIGS. 8-9, the first non-metal tube 12 includes a first tube inner diameter 50 and a plurality of first openings 52 are formed through a wall of the first non-metal tube 12. The plurality of first openings 52 may have any suitable spacing, size and shape. The first tube inner diameter 50 is sized to slidably receive an outer diameter of the first raised sleeve support section 30 and the first reduced diameter 42. The first non-metal tube 12 is preferably fabricated from carbon fiber, but other non-metal materials could also be used.

The sleeve nut 16 preferably includes a tube end 54 and a rotation flange 56. The rotation flange 56 is formed on an end of the tube end 54. A threaded bore 58 is formed through a length of the sleeve nut to threadably receive the sleeve thread 38 of the elongated tube 20. A plurality of pin holes 60 are formed in the rotation flange 56 to receive pins of a spanner wrench. The second non-metal tube 14 includes a second tube inner diameter 62 and a plurality of second openings 64 are formed through a wall of the second non-metal tube 14. The plurality of second openings 64 may have any suitable spacing, size and shape. The second tube inner diameter 62 is sized to slidably receive an outer diameter of the second reduced diameter 44 and the tube end 54 of the sleeve nut 16. The second non-metal tube 14 is preferably fabricated from carbon fiber, but other non-metal materials could also be used.

The firearm barrel with non-metal outer sleeve 1 is preferably assembled in the following manner. The first non-metal tube 12 is slid over the exit end of the elongated tube 20 on to the first raised sleeve support section 30. The coupler bushing 18 is slid over the exit end of the elongated tube 20 and on to the raised coupler section 32. The first reduced diameter 42 of the coupler bushing 18 is slid into a first tube inner diameter 50 of the first non-metal tube 12. The reduced diameter 33 has a diameter measurement, which is less than a diameter measurement of the first reduced diameter 42, the second reduced diameter 44 and the tube end 54 to create an air gap between the reduced diameter 33 and the first and second tube inner diameters 50, 62. The combination gas escape and fastener hole 46 of the bushing sleeve 18 is aligned with the gas escape hole 34 of the elongated barrel 20. A gas block 102 is slid over the bushing sleeve 18. A threaded fastener 66 is inserted through a hole 104 in the gas block 102 and threaded into the threaded tap 48 in the coupler bushing 18. The second non-metal tube 14 is slid over the exit end of the elongated tube 20 and on to the second reduced diameter 44 of the coupler bushing 18. The sleeve nut 16 is threaded onto the sleeve thread 38 to retain the first and second non-metal tubes 12, 14 on the elongated tube 20. Heat from the elongated barrel 20 escapes through the plurality of first and second openings 52, 64.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A firearm barrel with a non-metal outer sleeve comprising: a barrel tube that includes an outer barrel diameter, an inner barrel diameter, an entrance end and an exit end, and a sleeve thread is formed on said exit end; a first non-metal tube that includes a first inner diameter and a plurality of first openings, said plurality of first openings are formed through a first wall of said first non-metal tube; a second non-metal tube that includes a second inner diameter and a plurality of second openings, said plurality of second openings are formed through a second wall of said second non-metal tube; a coupler bushing that includes a coupler inner diameter, and said coupler inner diameter is in direct contact with said barrel tube, a first end of said coupler bushing is sized to receive said first inner diameter, a second end of said coupler bushing is sized to receive said second inner diameter; a gas block that includes a gas inner diameter, said gas inner diameter is in contact with an outer diameter of said coupler bushing, and said gas block is attached to said coupler bushing with a fastener; a sleeve nut that includes a sleeve inner thread, wherein said barrel tube is inserted through said first non-metal tube, said coupler bushing and said second non-metal tube, and said sleeve nut is threaded on to said sleeve thread to retain said first non-metal tube, said coupler bushing and said second non-metal tube.

2. The firearm barrel with the non-metal outer sleeve of claim 1 wherein: said first and second non-metal tubes are fabricated from carbon fiber.

3. The firearm barrel with the non-metal outer sleeve of claim 1, further comprising: an extension barrel that is threaded into an entrance end of said barrel tube.

4. The firearm barrel with the non-metal outer sleeve of claim 1 wherein: said sleeve nut includes a tube end and a rotation flange, and said tube end extends from said rotation flange, said sleeve nut is sized to receive said second inner diameter.

5. The firearm barrel with the non-metal outer sleeve of claim 1 wherein: a lead-in bore is formed concentric with said inner barrel diameter at said entrance end.

6. A firearm barrel with the non-metal outer sleeve comprising: a barrel tube that includes an outer barrel diameter, an inner barrel diameter, an entrance end and an exit end, and a sleeve thread that is formed on said exit end, and a barrel gas escape hole is formed through a barrel wall of said barrel tube; a first non-metal tube includes a first inner diameter and a plurality of first openings, said plurality of first openings are formed through a first wall of said first non-metal tube; a second non-metal tube that includes a second inner diameter and a plurality of second openings, said plurality of second openings are formed through a second wall of said second non-metal tube; a coupler bushing that includes a coupler inner diameter, and said coupler inner diameter is in direct contact with said barrel tube, a first end of said coupler bushing is sized to receive said first inner diameter, a second end of said coupler bushing is sized to receive said second inner diameter, and a bushing gas escape hole is formed through a bushing wall of said coupler bushing; a gas block that includes a gas inner diameter, and said gas inner diameter is in contact with an outer diameter of said coupler bushing, and said gas block is attached to said coupler bushing with a fastener, and said gas block communicates with said bushing gas escape hole; and a sleeve nut that includes a sleeve inner thread, wherein said barrel tube is inserted through said first non-metal tube, said coupler bushing and said second non-metal tube, and said sleeve nut is threaded on to said sleeve thread to retain said first non-metal tube, said coupler bushing and said second non-metal tube, said barrel gas escape hole is aligned with said bushing gas escape hole.

7. The firearm barrel with the non-metal outer sleeve of claim 6 wherein: a first air gap and a second air gap are created between said first and second inner diameters and said outer diameter of said barrel tube.

8. The firearm barrel with the non-metal outer sleeve of claim 6 wherein: said first and second non-metal tubes are fabricated from carbon fiber.

9. The firearm barrel with the non-metal outer sleeve of claim 6, further comprising: an extension barrel that is threaded into an entrance end of said barrel tube.

10. The firearm barrel with the non-metal outer sleeve of claim 6 wherein: said sleeve nut includes a tube end and a rotation flange, said tube end extends from said rotation flange, and said sleeve nut is sized to receive said second inner diameter.

11. The firearm barrel with the non-metal outer sleeve of claim 6 wherein: a lead-in bore that is formed concentric with said inner barrel diameter at said entrance end.

12. A firearm barrel with a non-metal outer sleeve comprising: a barrel tube that includes an outer barrel diameter, an inner barrel diameter, an entrance end and an exit end, and a sleeve thread that is formed on said exit end; a first non-metal tube includes a first inner diameter and a plurality of first openings, said plurality of first openings are formed through a first wall of said first non-metal tube, and a first air gap exists between said outer barrel diameter and said first inner diameter, and an outer barrel diameter is sized to receive said first inner diameter at said entrance end; a second non-metal tube includes a second inner diameter and a plurality of second openings, said plurality of second openings are formed through a second wall of said second non-metal tube, and a second air gap exists between said outer barrel diameter and said second inner diameter; a coupler bushing that includes a coupler inner diameter, a first end of said coupler bushing is sized to receive said first inner diameter, and a second end of said coupler bushing is sized to receive said second inner diameter; and a sleeve nut includes a sleeve inner thread, wherein said barrel tube is inserted through said first non-metal tube, said coupler bushing and said second non-metal tube, said sleeve nut is threaded on to said sleeve thread to retain said first non-metal tube, a coupler bushing and said second non-metal tube, each end of said first and second non-metal tubes are coupled to said barrel.

13. The firearm barrel with the non-metal outer sleeve of claim 12 wherein: said first and second non-metal tubes are fabricated from carbon fiber.

14. The firearm barrel with the non-metal outer sleeve of claim 12, further comprising: an extension barrel is threaded into an entrance end of said barrel tube.

15. The firearm barrel with the non-metal outer sleeve of claim 12 wherein: said sleeve nut includes a tube end and a rotation flange, said tube end extends from said rotation flange, said sleeve nut sized to receive said second inner diameter.

16. The firearm barrel with the non-metal outer sleeve of claim 12 wherein: a lead-in bore is formed concentric with said inner barrel diameter at said entrance end.

* * * * *